US006038699A

United States Patent [19]

Han et al.

[11] Patent Number: 6,038,699

[45] Date of Patent: Mar. 21, 2000

[54] CLEAN ROOM SMOCK HAVING AN INTEGRAL AIR PASSAGE

[75] Inventors: Youn-soo Han, Kyungki-do; Hyeung-ki Kim, Seoul; Hyun-joon Kim; Seung-un Kim, both of Kyungki-do, all of Rep. of Korea

[73] Assignee: Samsung Electronics Co., Ltd., Suwon, Rep. of Korea

[21] Appl. No.: 09/184,851

[22] Filed: Nov. 3, 1998

[30] Foreign Application Priority Data

Dec. 8, 1997 [KR] Rep. of Korea ..... 97-66719

[51] Int. Cl.[7] ..... A41D 1/06

[52] U.S. Cl. ..... 2/69; 2/79; 2/455; 2/DIG. 1

[58] Field of Search ..... 2/69.79, 69.1, 2/70, 227, DIG. 1, 901, 902, 81, 455, 456

[56] References Cited

U.S. PATENT DOCUMENTS

| | | | |
|---|---|---|---|
| 2,331,283 | 10/1943 | Wheeler | 2/81 |
| 3,496,572 | 2/1970 | Herzig | 2/79 |
| 4,932,078 | 6/1990 | Jones et al. | 2/70 |
| 5,586,339 | 12/1996 | Lathan | 2/69 |
| 5,784,717 | 7/1998 | Singer et al. | 2/79 |

*Primary Examiner*—Gloria Hale
*Attorney, Agent, or Firm*—Jones Volentine, LLP

[57] ABSTRACT

A smock to be worn by a clean room operator includes an upper material part for covering the upper body of the operator, a lower material part for covering the lower body of the operator, wherein the upper material part and the lower material part are integrally formed. An air passage within the smock connects the upper material part and the lower material part, and a discharge part is in flow communication with the air passage for venting the air within the smock.

6 Claims, 3 Drawing Sheets

CLEAN ROOM SMOCK HAVING AN INTEGRAL AIR PASSAGE

BACKGROUND OF THE INVENTION

1. Field of the Invention

The present invention relates to a clean room smock, and more particularly, to a clean room smock having an integral air passage for preventing contamination of a clean room and processing equipment located in the clean room, caused by particles generated from the human body.

2. Description of the Related Art

As the desire for higher quality devices and higher device production yields continue to increase, so does the demand for highly-purified and germ-free production environments for manufacturing such devices.

The two main types of production environments are Bio Clean Rooms (BCRs), for preventing biological contamination in medicine, food, genetically engineered products, etc., and Industrial Clean Rooms (ICRs), for preventing particle contamination in the semiconductor device, electronics, and precision machinery industries.

In semiconductor device manufacturing clean rooms, clean air flows through a filter in the upper portion of the clean room, then downwardly toward the lower portion of the clean room, and finally through a grating supporting production equipment located thereon, before being discharged and recirculated.

In addition to the clean room structure itself, the clothing or smock worn by the workers and equipment operators in the clean room is also very important in reducing particle contamination. The clean room smock prevents particles from the human body from entering the clean room environment, thereby reducing contamination.

The material for the smock is chosen based on such considerations as wearing-comfort, particle filtration efficiency, particle generation barriers, etc. In general, the conventional smock materials have provided high particle filtration efficiency and low particle generation, but the comfort of the operator is compromised somewhat in the process.

In FIG. 1 the conventional clean room smock 10 comprises an upper part 12 to cover the upper body above the waist, and a lower part 14 to cover the lower body below the waist. Normally, the upper part 12 and the lower part 14 are integrally formed. For wearing-comfort, a belt member 16, such as elastic band, is threaded through a normal belt ring 18 and conforms to the waist of the operator.

An opening/closing part 20 is formed on a certain portion of the upper part 12 so that an operator can easily put on the smock. In order prevent the air and particles from coming out of the smock while the operator is performing job tasks, an elastic band or similar means is provided at the openings for the neck line 22, wrist line 24 and ankle line 26.

The material for the smock 10 is highly dense to prevent air filtration from the inside to the outside of the smock, and accordingly, the pressure inside the smock is higher than that outside the smock because of the activity of the operator.

In addition, inside the smock itself, the pressure of the upper part 12 is higher than that of the lower part 14 because the upper part 12 and the lower part 14 are separated by the belt member 16, and the upper body of the operator experiences more activity that the lower body.

The air inside the smock, intermixed with particles from the body, flows to the outside of the smock due to the pressure difference between the inside and the outside the smock, or the pressure difference between the inner upper part 12 and the inner lower part 14, especially, through the openings for the neck line 22, wrist line 24, or zipper of the opening/closing part 20, as well as the seams of the smock.

For ease of handling and comfort, the processing equipment or devices in the clean room are usually located at heights equivalent to those of the upper body of an operator, and thus the equipment and devices are contaminated by the particles emanating from inside the upper part 12 of the smock.

In addition, the pressure difference creates static electricity due to friction between the body and the smock, which causes particles having electrical polarity to adhere to the outer surface of the smock, thereby increasing the likelihood of contamination of the equipment or devices.

SUMMARY OF THE INVENTION

The present invention is directed to a clean room smock for preventing particle contamination by providing a discharge path to guide the particles generated from the body of an operator, which overcomes one or more problems due to the limitations and disadvantages of the related art.

Another object of the present invention is to provide a clean room smock for preventing contamination due to particles having electrical polarity by preventing the expansion of the smock that is attributable to its pressure difference, and suppressing the static electricity due to the friction between the operator's body and the smock material.

To achieve these and other advantages and in accordance with the purpose of the present invention as embodied and broadly described, there is provided a smock to be worn by a clean room operator, the smock including an upper material part for covering the upper body of the operator, a lower material part for covering the lower body of the operator, wherein the upper material part and the lower material part are integrally formed. An air passage within the smock connects the upper material part and the lower material part, and a discharge part is in flow communication with the lower material part of the smock for venting the air within the smock.

The air passage is comprised of a tubular shaped belt ring that connects the upper and lower material parts, outwardly of a cinching means that is formed between the upper and lower material parts. A tube or pipe, made of a resilient material, can be inserted inside the belt ring to keep the air passage open by preventing the creasing of the air passage while the operator is moving or bending over.

The discharge part is installed along the lower material part of the smock, at a location corresponding to between the knee and the ankle of the operator. The discharge part is covered with filter paper to allow the air to pass through, while preventing particles generated by the operator from entering the clean room.

It is to be understood that both the foregoing general description and the following detailed description are exemplary and explanatory and are intended to provide further explanation of the invention as claimed.

BRIEF DESCRIPTION OF THE INVENTION

DETAILED DESCRIPTION OF THE PREFERRED EMBODIMENTS

The present invention now will be described more fully hereinafter with reference to the accompanying drawings, in which a preferred embodiment of the invention is shown.

Figure 1:
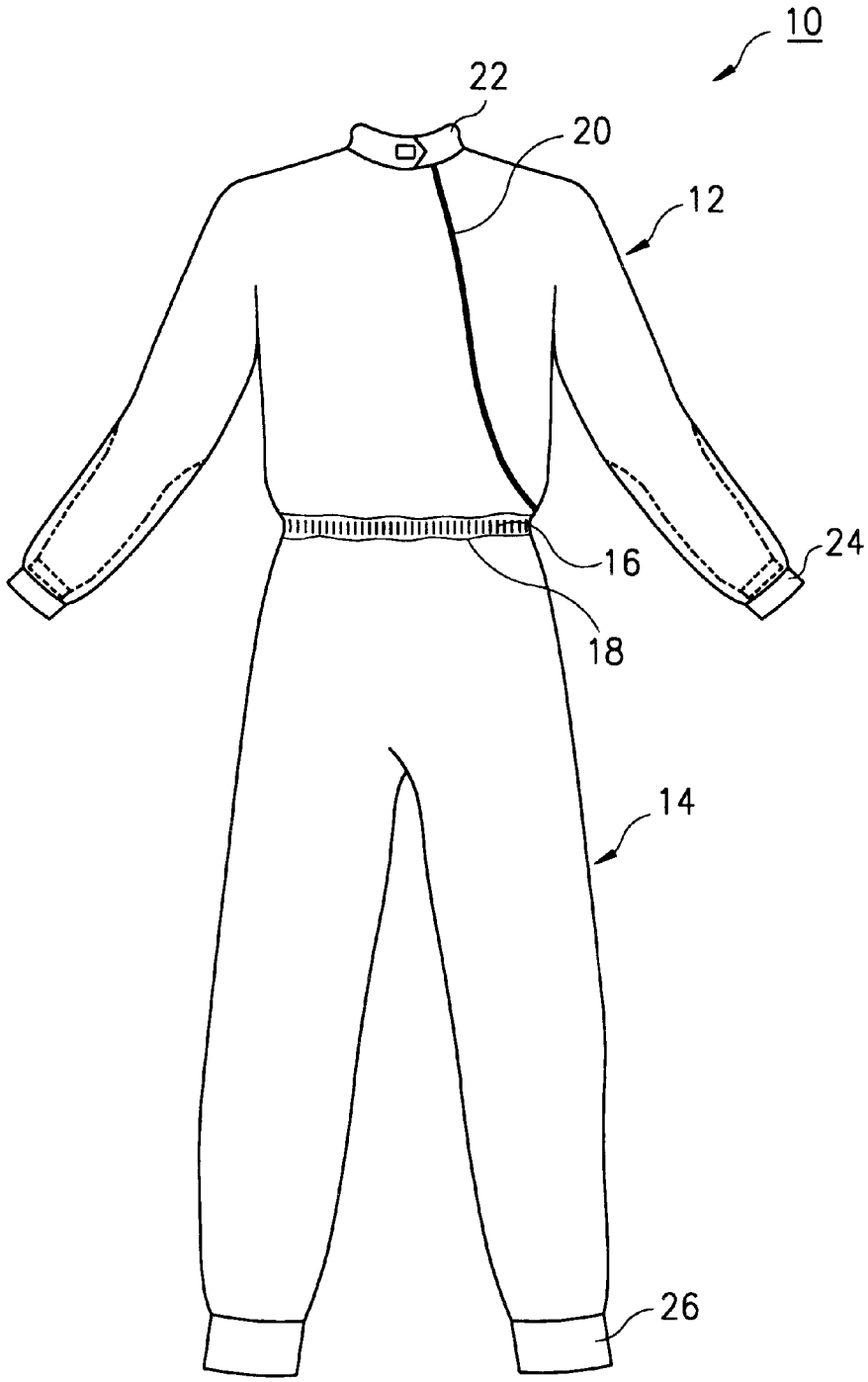
FIG. 1 (PRIOR ART)
FIG. 1 shows a conventional clean room smock.
Figure 2:
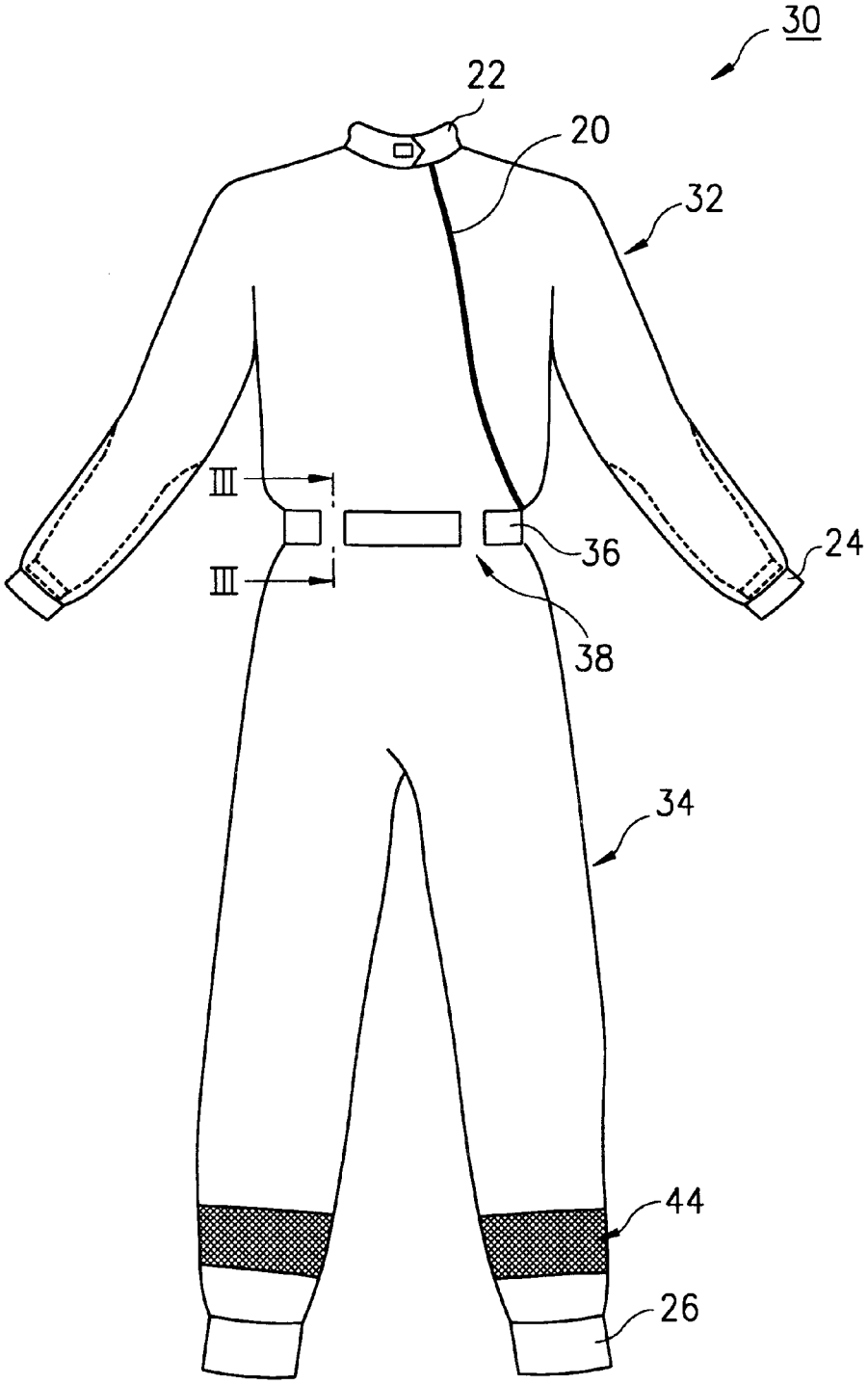
FIG. 2 shows a clean room smock according to one embodiment of the present invention.
Figure 3:
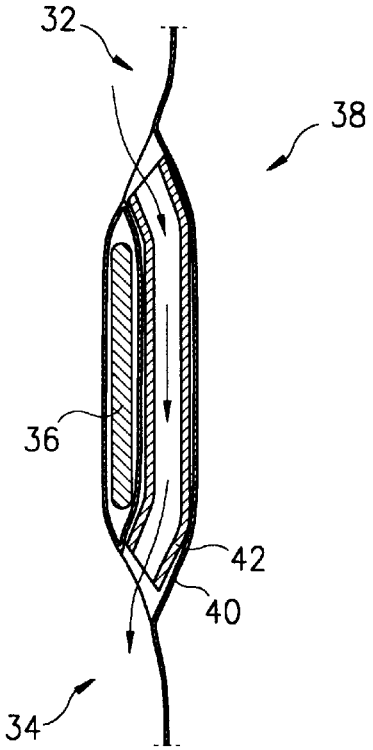
FIG. 3 is a sectional view of the air passage provided at the waist portion of the smock shown at III—III of FIG. 2.
Figure 4:
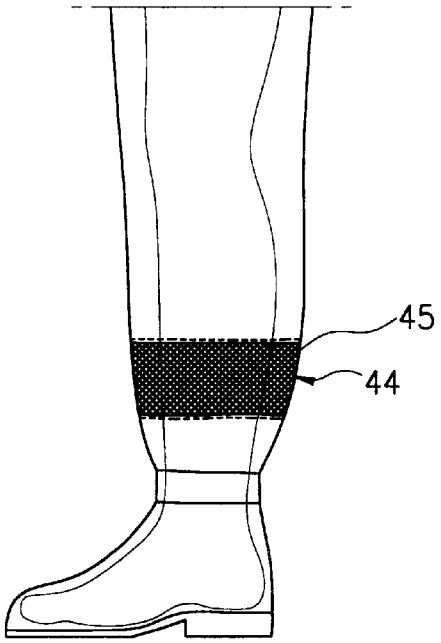
FIG. 4 shows an enlarged view of the discharge part of the smock located along one side of an operator's leg.

FIG. 2 illustrates a front view of the clean room smock according to the present invention, FIG. 3 illustrates a sectional view of the waist portion of the smock, and FIG. 4 illustrates a side view of the leg portion of the smock.

The clean room smock 30 includes an upper material part 32 covering the upper body above the waist, and a lower material part 34 covering the lower body below the waist, wherein the upper material part 32 and the lower material part 34 are integrally formed.

The smock 30 includes a belt member 36, such as an elastic band, belt, or similar cinching means, that compresses or cinches the waist portion of the smock 30 to increase the flexibility and comfort of the operator. However, the belt member 36 precludes any appreciable exchange of air between the upper material part 32 and the lower material part 34. Therefore, in the present invention, an air passage 38 connects the upper material part 32 and the lower material part 34, with the air passage 38 being outward of and centered near the belt member 36.

Preferably, as shown in FIGS. 2 and 3, a plurality of air passages 38 are spaced along the waist portion of the smock 30, with the air passages 38 being integrated with a belt-ring 40. The belt ring 40 helps to fix the belt member in place. In addition, the belt ring 40 is tubular shaped so to allow air to travel therethrough, between the inside of the upper material part 32 and the inside of the lower material part 34.

In addition, a tube or pipe 42 made of a resilient material can be inserted inside the belt ring 40 to keep the air passage 38 open by preventing the creasing of the air passage while the operator is moving or bending over.

As shown in FIG. 4, a discharge part 44 is installed at a certain location on the lower material part 34 in order to allow air to be discharged from the inside of the smock 30 to the outside as a result of the pressure differential described above. Filter paper 45, that is sewn or otherwise attached to the discharge part 44, allows air to be discharged from the inside of the smock 30 to the outside while preventing particles entrained in the air from passing through.

Preferably, the discharge part 44 is located a certain distance, about 100 to 120 mm, from the bottom of the lower hem or ankle opening 26 to prevent folding. In other words, the discharge part 44 is placed above the ankle and below the knee. The upward vertical width of the filter paper for the discharge part 44 is about 35 to 45 mm, and the material for the filter paper should be selected so as to generate less particles, prevent the generation of the static electricity, and filter the air flowing through the smock.

The discharge part 44 is formed by cutting a certain portion of the lower material part 34 to form openings of a desired size, and then the filter paper 45 is attached to the smock 30 by any conventional means to thereby cover the openings.

Therefore, when worn by the operator, the pressure of the upper material part 32 inside the smock 30 is higher than the lower material part 34 inside the smock 30, such that the air inside the upper material part 32 moves toward the lower material part 34 through the air passage 38, along with the particles generated from the human body until the pressure inside the upper material part 32 and the lower part 34 is equalized.

Meanwhile, the pressure inside the lower material part 34 of the smock 30 is still higher than the clean room, and accordingly, the air in the lower material part 34 is discharged through the discharge part 44 formed on a portion of the lower material part 34 until the pressure inside and outside the smock 30 is equalized. The filter paper 45 covering the discharge part 44 prevents particles of a certain size from reaching the clean room environment. Those particles that do escape the smock 30 are forced downward by the downward laminar flow in the clean room, toward the grating were is it then discharged, filtered and recirculated.

Since the pressure inside the smock 30 is equalized with the outside of the smock, the particles are not forced through the seams by any pressure differential, and static electricity is reduced because there is less expansion in the smock material due to any pressure differential.

Therefore, according to the present invention, the air inside the smock flows through the air passage and exits the discharge part formed on the lower part of the smock, and the particles inside the smock are prevented from escaping, thereby preventing contamination in the clean room. In addition, any expansion caused by a pressure differential inside and outside the smock is prevented. Moreover, by reducing static electricity, there is a corresponding reduction in particles having electrical polarity that are adhered to the smock, thereby further reducing particle contamination in the clean room.

Additional advantages and modifications will readily occur to those skilled in the art. Therefore, the invention in its broader aspects is not limited to the specific details, and representative devices, shown and described therein. Accordingly, various modifications may be made without departing from the spirit or scope of the general inventive concept as defined by the appended claims and their equivalents.

What is claimed is:

1. A smock to be worn by a clean room operator, the smock comprising:

an upper material part for use in covering an upper body of the operator;

a lower material part for use in covering a lower body of the operator, wherein the upper material part and the lower material part are integrally formed;

a cinching means formed between the upper material part and the lower material part;

an air passage, formed outwardly of the cinching means, connecting the upper material part and the lower material part; and a discharge part in flow communication with the lower material part for venting the air within the smock.

2. The smock of claim 1, wherein the air passage comprises a tubular shaped belt ring.

3. The smock of claim 2, further comprising a resilient tube inserted within the tubular shaped belt ring.

4. The smock of claim 1, wherein the discharge part is located between a knee portion and an ankle portion of the lower material part of the smock.

5. The smock of claim 4, wherein the discharge part is located 100 to 120 mm upwardly from a lower hem portion of the lower material part.

6. The smock of claim 4, further comprising filter paper attached to the discharge part for preventing particles from flowing from inside the smock to outside the smock.

* * * * *